US011219278B1

(12) United States Patent
Ting

(10) Patent No.: US 11,219,278 B1
(45) Date of Patent: Jan. 11, 2022

(54) DOUBLE-SIDED BELT BUCKLE IMPROVEMENT

(71) Applicant: CHUN-DA FURS CO., LTD., Changhua Hsien (TW)

(72) Inventor: Jung-Lang Ting, Changhua Hsien (TW)

(73) Assignee: CHUN-DA FURS CO., LTD., Changhua Hsien (TW)

( * ) Notice: Subject to any disclaimer, the term of this patent is extended or adjusted under 35 U.S.C. 154(b) by 0 days.

(21) Appl. No.: 17/035,670

(22) Filed: Sep. 28, 2020

(51) Int. Cl.
*A44B 11/00* (2006.01)
*A44B 11/22* (2006.01)
*A41F 9/00* (2006.01)

(52) U.S. Cl.
CPC ..... *A44B 11/006* (2013.01); *A44B 11/001* (2013.01); *A44B 11/22* (2013.01); *A41F 9/002* (2013.01); *A44D 2200/10* (2013.01)

(58) Field of Classification Search
CPC ..... A44B 11/006; A44B 11/22; A44B 11/001; A41F 9/002; A44D 2200/10
See application file for complete search history.

(56) References Cited

U.S. PATENT DOCUMENTS

| | | | | |
|---|---|---|---|---|
| 3,204,314 | A * | 9/1965 | Sokoloff | A44B 11/24 24/188 |
| 7,181,808 | B1 * | 2/2007 | Van Winkle | A44B 11/223 24/170 |
| D708,549 | S * | 7/2014 | Kao | D11/234 |
| 9,345,288 | B1 * | 5/2016 | Greenberg | A44B 11/24 |
| 2011/0232044 | A1 * | 9/2011 | Chen | A44B 11/001 24/163 K |
| 2014/0259545 | A1 * | 9/2014 | King | A41F 9/002 24/170 |
| 2016/0200563 | A1 * | 7/2016 | Chen | B68C 1/14 24/178 |
| 2020/0022461 | A1 * | 1/2020 | Huang | A44B 11/24 |

* cited by examiner

*Primary Examiner* — David M Upchurch
(74) *Attorney, Agent, or Firm* — Leong C. Lei

(57) ABSTRACT

The double-sided belt buckle includes a chape member, a frame, a prong, and a loop element. The chape member includes a hinge element, a first side, and a second side. The hinge element and the frame are pivotally joined together. The prong is pivotally joined to the frame for running through a hole along another end of the strap. A user may choose to use the first or second side of the chape member as the outward facing side. The prong then may be pushed so that the prong may freely swivel within the frame. After releasing the prong, the prong may be applied to fasten a strap of the belt buckle corresponding to the outward facing side, thereby enhancing the flexibility of the belt buckle.

10 Claims, 7 Drawing Sheets

DOUBLE-SIDED BELT BUCKLE IMPROVEMENT

BACKGROUND OF THE INVENTION

(a) Technical Field of the Invention

The present invention is generally related to clothing accessories, and more particular to a double-sided belt buckle.

(b) Description of the Prior Art

Republic of China (Taiwan) Patent No. M597586, filed by the present applicant, taught a belt buckle whose either one of its two sides may be used to face outward.

The double-sided effect of the mentioned prior art is achieved mainly through a detachable prong, and a drawback of this design is that the prong may be lost after detachment.

The present applicant, therefore, developed an improved double-side belt buckle.

SUMMARY OF THE INVENTION

An objective of the present invention is to provide a double-sided belt buckle so as to obviate the shortcoming of a conventional belt buckle.

To achieve the objective, the double-sided belt buckle is connected to an end of a strap of a belt, and includes a chape member, a frame, a prong, and a loop element.

The chape member includes a hinge element, a first side, and a second side. The hinge element and the frame are pivotally joined together. The loop element is selectively joined to the first side or the second side of the chape member perpendicular to the hinge element, depending on which of the first and second sides of the chape member is used as an outward facing side.

The frame has two neighboring notches along a front section of the frame, respectively corresponding to the first and second sides.

The prong is pivotally joined to the frame for running through a hole along another end of the strap.

The prong includes a C-shaped hinge section, a prong section, and an elastic element joined to an inside of the hinge section. The hinge section is joined to a first end of the prong section. The hinge element has an opening. The hinge section runs through the opening and is pivotally joined to the frame. The prong is selectively pushed to compress the elastic element so that the prong is freely swivel within the frame. After releasing the elastic element, a second end of the prong section is embedded into one of the notches after the prong runs through a hole of the strap.

In one embodiment, the elastic element is a compression spring.

In one embodiment, the elastic element is adhered to the inside of the hinge section.

In one embodiment, the elastic element is welded to the inside of the hinge section.

In one embodiment, the elastic element is joined to the inside of the hinge section by high-frequency processing.

Through the above described structure, the present invention provides the following advantages.

1. The prong may be used for either side of the chape member as the outward facing side without being detached.

2. The belt buckle is structurally simple and may be operated easily by a user without instruction, thereby enhancing the belt buckle's applicability.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
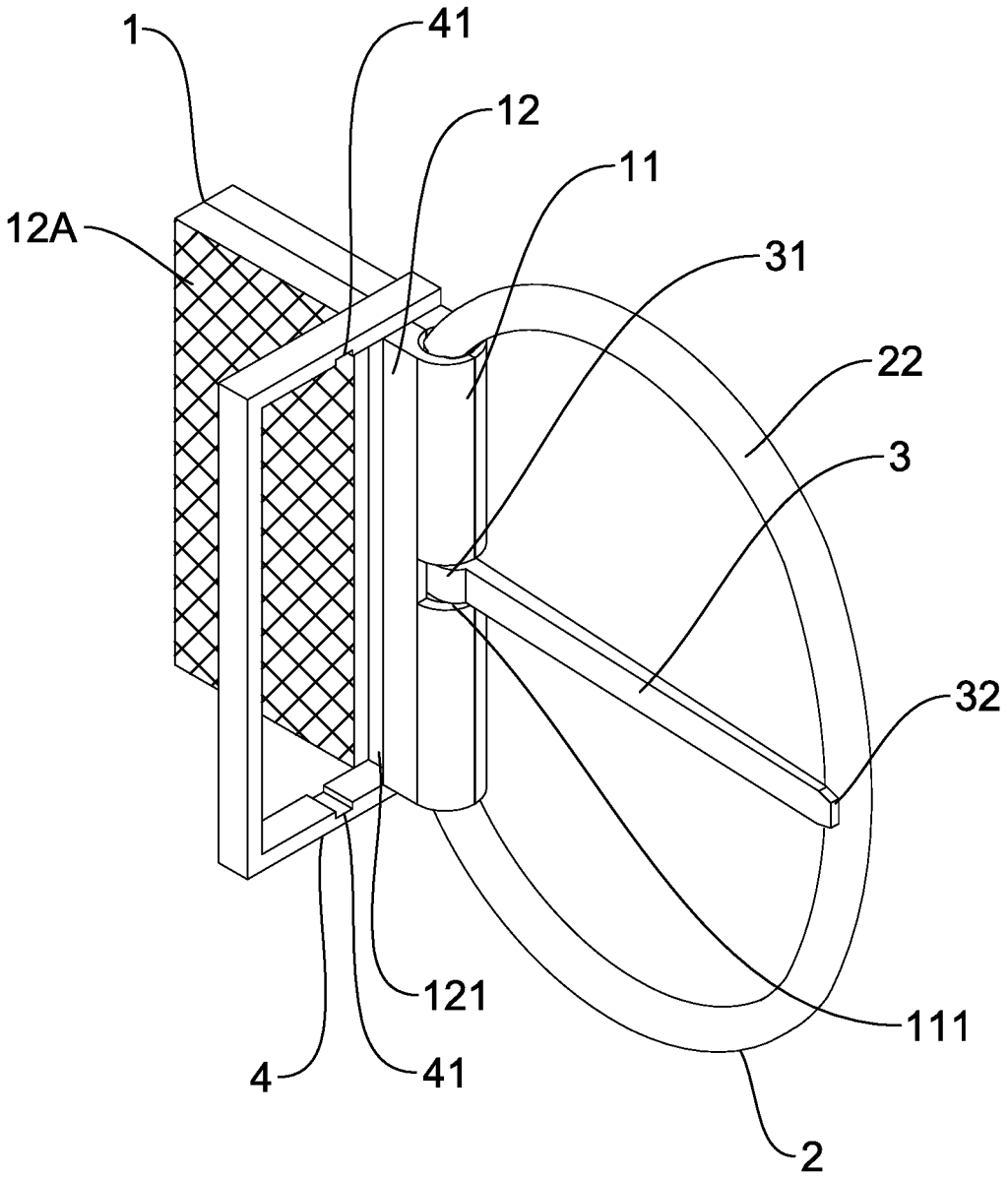
FIG. 1 is a perspective diagram showing a double-sided belt buckle according to an embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, a double-sided belt buckle according to an embodiment of the present invention mainly includes a chape member 1, a frame 2, a prong 3, and a loop element 4.

As illustrated in FIGS. 1 to 5, the frame 2, the prong 3, and the loop element 4 are configured on the chape member 1. In the present embodiment, the chape member 1 has a cubical shape and the chape member 1 includes a hinge element 11, a first side 12, and a second side 13. The hinge element 11 and the frame 2 are pivotally joined together. The loop element 4 is joined to the chape member 1 perpendicular to the hinge element 11. When put to use, a user may choose to have the first side 12 or the second side 13 facing outward.

Figure 2:
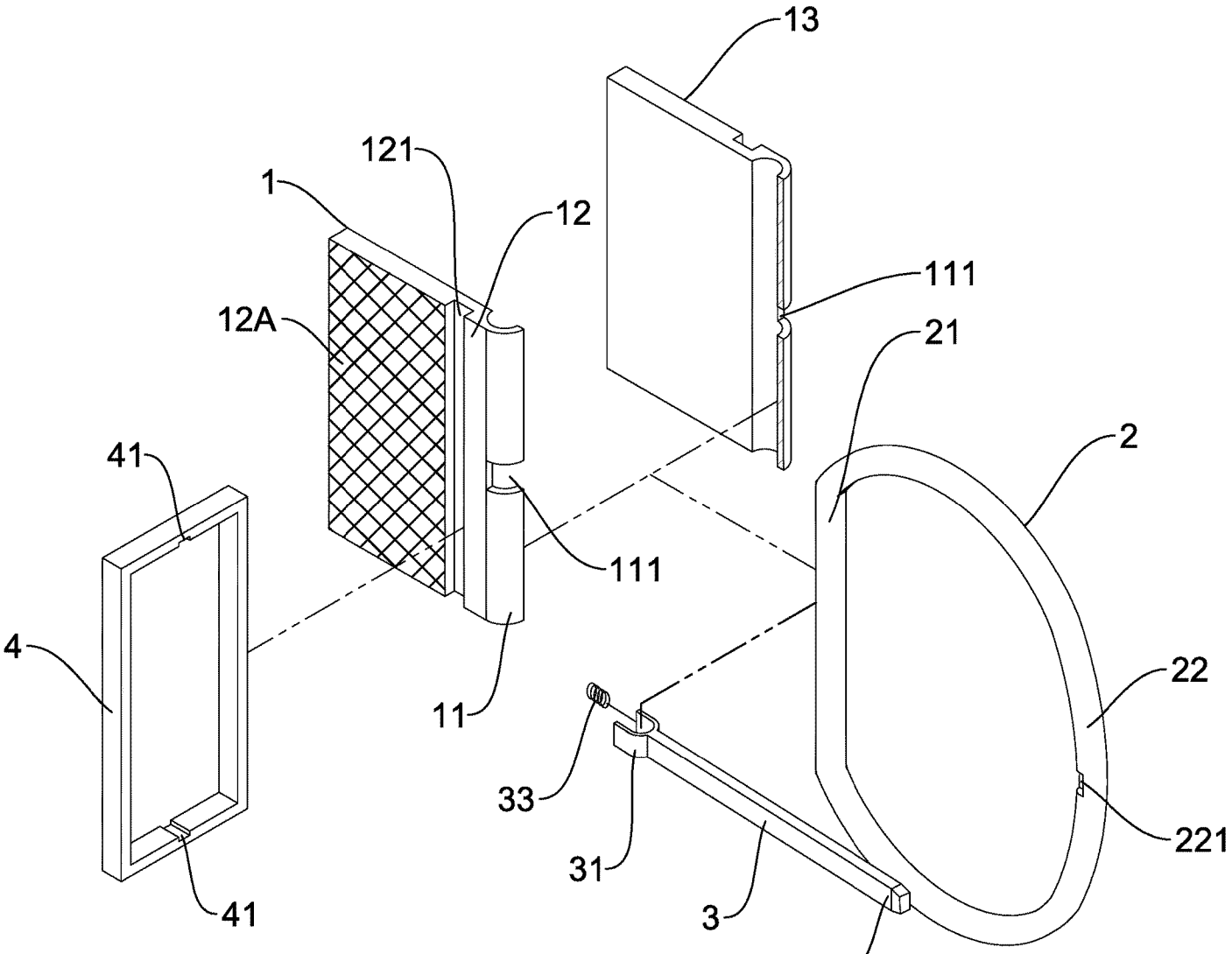
FIG. 2 is a perspective break-down diagram showing the double-sided belt buckle of FIG. 1.
Figure 3:
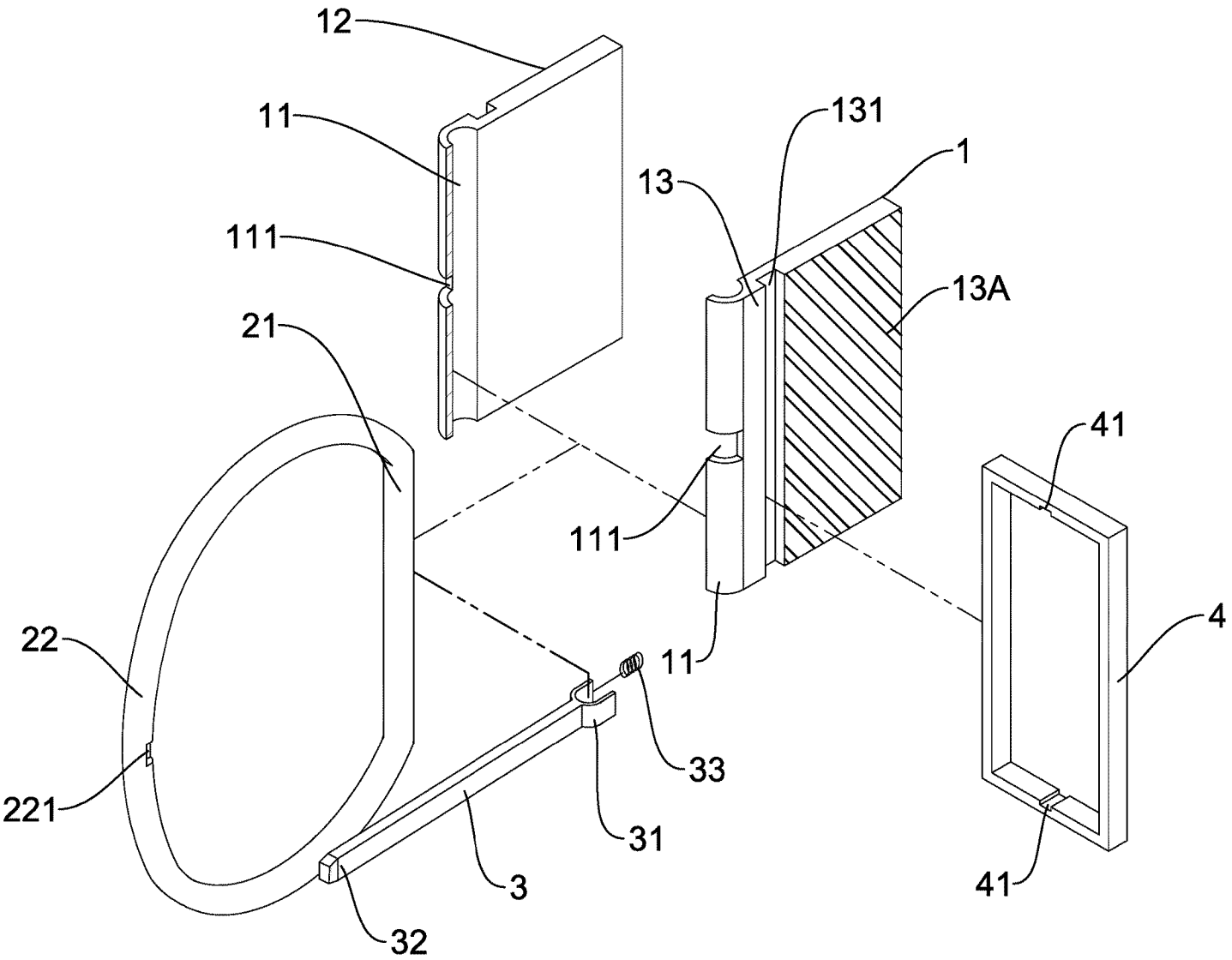
FIG. 3 is another perspective break-down diagram showing the double-sided belt buckle of FIG. 1.

As shown in FIGS. 2 and 3, the first side 12 and the second side 13 may be respectively configured with decorated faces 12A and 13A with different colors, textures, shapes, or patterns. Of course, the decorated faces 12A and 13A may also be of a same color, texture, shape, or pattern.

As shown in FIGS. 2 and 3, the chape member 1 is composed of two symmetrical pieces flatly joined together with the frame 2 sandwiched in between. The two pieces may be joined by welding, adhesive, latches, screws, rivets, etc.

As shown in FIGS. 1 to 3, the frame 2 includes a linear section 21 and a C section 22, whose two ends are respectively joined to the two ends of the linear section 21, thereby forming a D shape. The linear section 21 is housed inside the hinge element 11. The hinge element 11 has an opening 111 in a middle section. An end of the prong 3 is connected to the linear section 21 through the opening 111. As shown in FIGS. 2 to 5, the C section of the frame 2 has two neighboring notches 221 and 222 in a middle section respectively corresponding to the first and second sides 12 and 13.

As shown in FIGS. 1 to 5, the prong 3 is joined to the frame 2 and engages a strap 5. The prong 3 includes a C-shaped hinge section 31, a prong section 32, and an elastic element 33 in the hinge section 31. The hinge section 31 is joined to a first end of the prong section 32. The elastic element 33 may be a compression spring or a silicone or rubber pad, and is joined to an inside the hinge section 31 through adhesive, welding, or high-frequency processing. As mentioned earlier, the hinge element 11 has an opening 111. The hinge section 31 runs through the opening 111 and is pivotally joined to the linear section 21. Through the hinge section 31, the prong 3 may swivel around the linear section 21.

Figure 6:
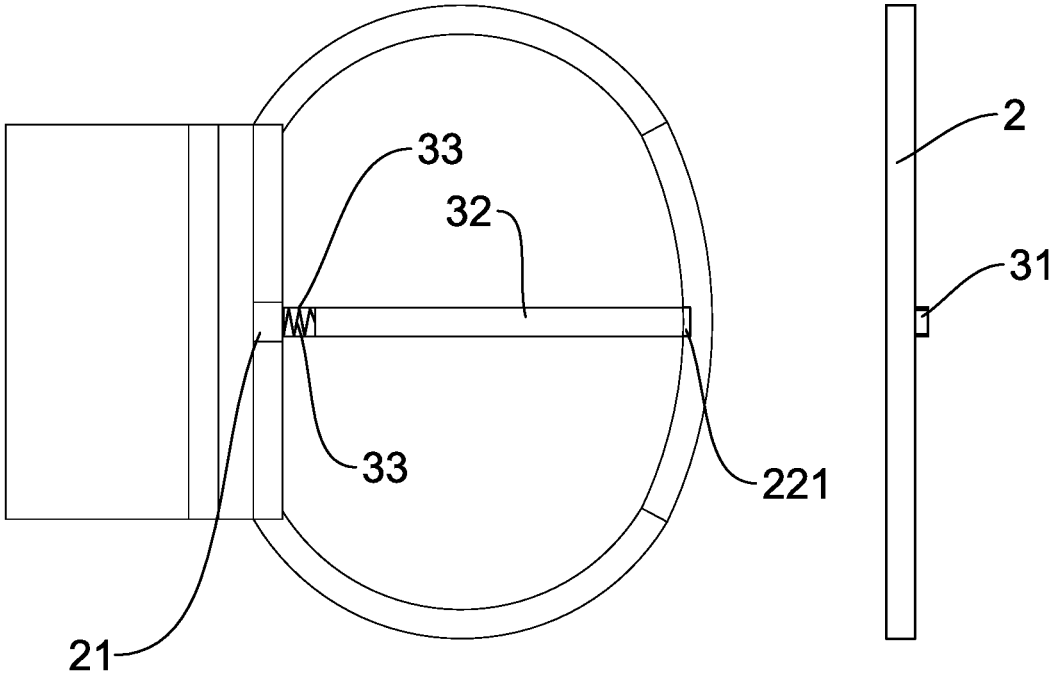
FIGS. 6 to 8 show scenarios of a prong being adapted to use with a side of the double-side belt buckle of FIG. 1.
Figure 7:
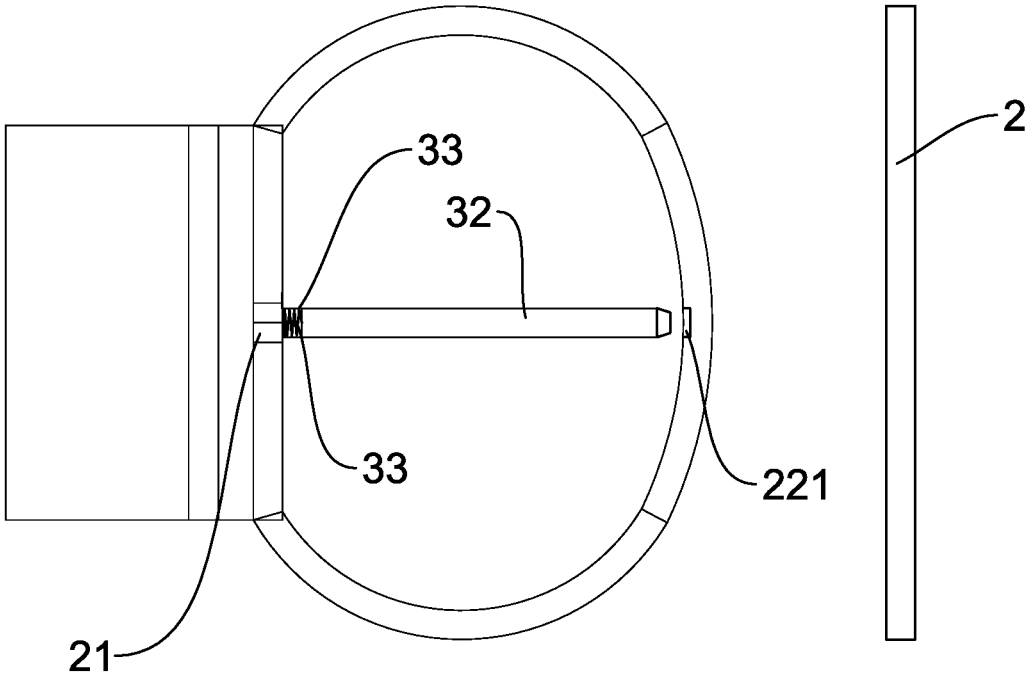
Figure 8:
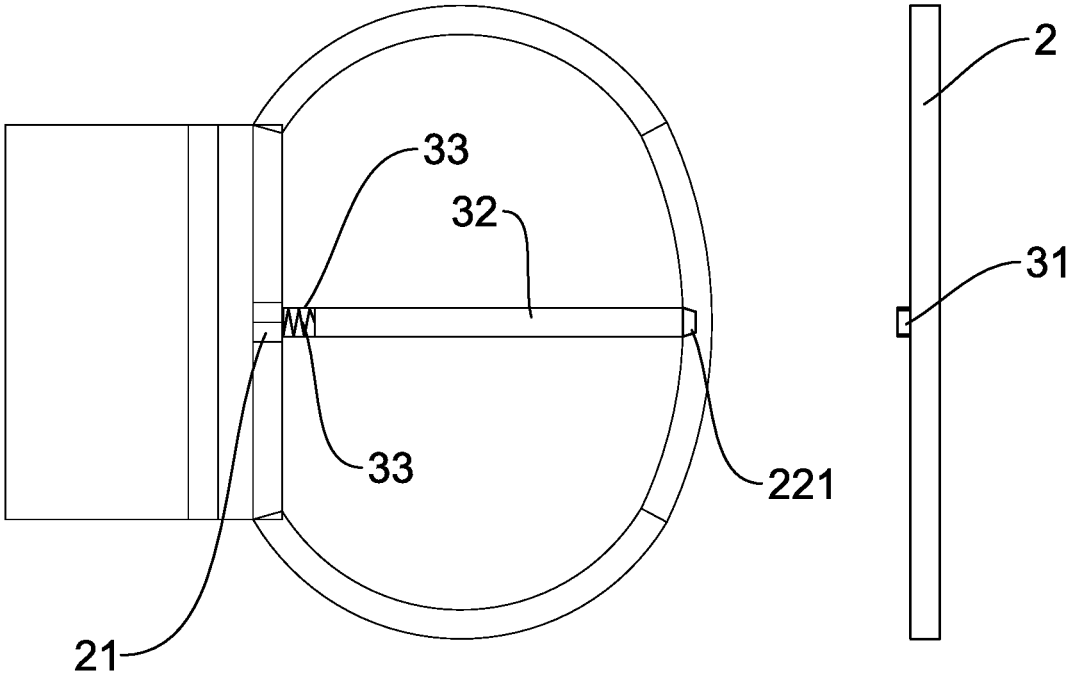

As shown in FIGS. 6 to 8, the prong 3 may be pushed to compress the elastic element 33 so that the prong 3 may freely swivel within the frame 2. After releasing the elastic element 33, a second end of the prong section 32 may be embedded into the notch 221 or 222 after the prong 3 runs through a hole of the strap 5 depending which side of the double-side belt buckle is used as the outward facing side.

As described above, the prong 3 of the present invention is not required to be detached, thereby preventing it from missing. from and again joined to the linear section 21, so that the prong 3 may be adjusted.

As shown in FIGS. 1 to 5, the loop element 4 maintains the position of the strap 5 after the strap 5 has run through the loop element 4. Two slots 41 are symmetrically configured along an inner wall of the ring-shaped loop element 4, which one is along an upper lateral section and one is at a lower lateral section. As shown in FIGS. 1 to 3, the first side 12 and the second side 13 have troughs 121 and 131, respectively, adjacent to the hinge element 11. The loop element 4 is detachably embedded in the trough 121 or 131.

Through the above described structure, the double-sided belt buckle provides the following functions.

Figure 4:
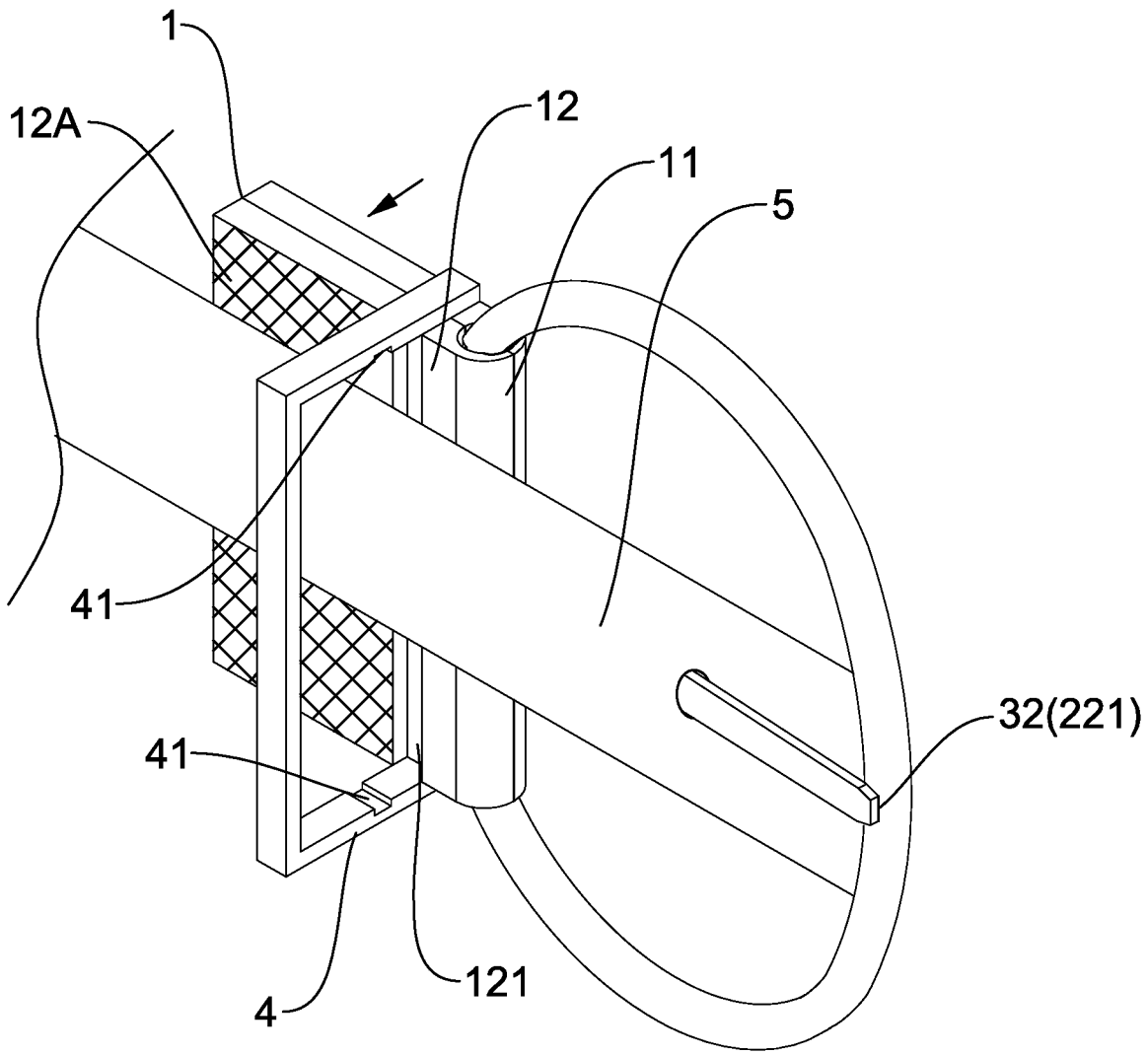
FIG. 4 shows an application scenario of the double-side belt buckle of FIG. 1.

1. As shown in FIG. 4, to use the first side 12 as the outward facing side, the loop element 4 has one of its vertical sections embedded into the trough 131 so that the loop element 4 is outward extended from the chape member 1. After the strap 5 runs through the frame 2 and the loop element 4, the prong 3 is threaded through a hole on the strap 5 and the prong section 32 of the prong 3 is rested in the notch 221 of the frame 2.

Figure 5:
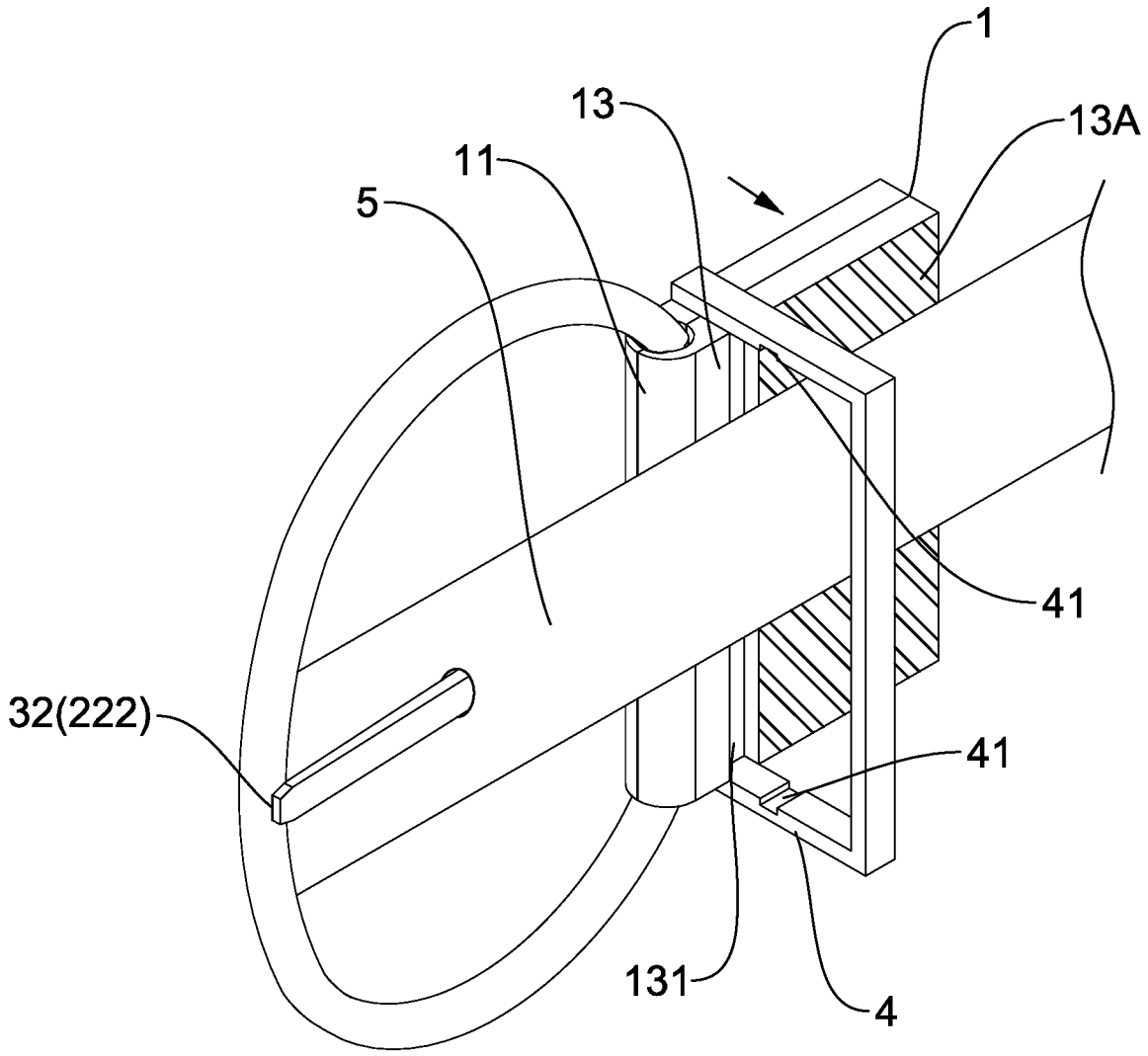
FIG. 5 shows another application scenario of the double-side belt buckle of FIG. 1.

2. As shown in FIG. 5, to use the second side 13 as the outward facing side, the loop element 4 has one of its vertical sections embedded into the trough 121 so that the loop element 4 is outward extended from the chape member 1. After the strap 5 runs through the frame 2 and the loop element 4, the prong 3 is threaded through a hole on the strap 5 and the prong section 32 of the prong 3 is rested in the notch 222 of the frame 2.

The first side 12 and the second side 13 of the chape member 1 may be designed to have different colors, styles, or textures, so that a user may reveal a different taste by using a specific side of the double-sided belt buckle. The frame 2 or the prong 3 may also be configured into having two styles matching the first or second side 12 or 13 used.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A double-sided belt buckle connected to an end of a strap of a belt, comprising a chape member, a frame, a prong, and a loop element, wherein the chape member comprises a hinge element, a first side, and a second side;

the hinge element and the frame are pivotally joined together;

the loop element is selectively joined to the first side or the second side of the chape member perpendicular to the hinge element;

the frame has two neighboring notches along a front section of the frame, respectively corresponding to the first and second sides;

the prong comprises a C-shaped hinge section, a prong section, and an elastic element joined to an inside of the hinge section;

the hinge section is joined to a first end of the prong section;

the hinge element has an opening;

the hinge section runs through the opening and is pivotally joined to the frame;

the prong is selectively pushed to compress the elastic element so that the prong is freely swivel within the frame; and after releasing the elastic element, a second end of the prong section is embedded into one of the notches after the prong runs through a hole of the strap.

2. The double-sided belt buckle according to claim 1, wherein the elastic element is a compression spring.

3. The double-sided belt buckle according to claim 1, wherein the elastic element is adhered to the inside of the hinge section.

4. The double-sided belt buckle according to claim 1, wherein the elastic element is welded to the inside of the hinge section.

5. The double-sided belt buckle according to claim 1, wherein the elastic element is joined to the inside of the hinge section by high-frequency processing.

6. The double-sided belt buckle according to claim 2, wherein the elastic element is adhered to the inside of the hinge section.

7. The double-sided belt buckle according to claim 2, wherein the elastic element is welded to the inside of the hinge section.

8. The double-sided belt buckle according to claim 2, wherein the elastic element is joined to the inside of the hinge section by high-frequency processing.

9. The double-sided belt buckle according to claim 1, wherein the elastic element is a silicone pad.

10. The double-sided belt buckle according to claim 9, wherein the elastic element is adhered to the inside of the hinge section.

* * * * *